US008582992B2

(12) United States Patent
Yamada et al.

(10) Patent No.: US 8,582,992 B2
(45) Date of Patent: Nov. 12, 2013

(54) IMAGE FORMING APPARATUS AND STORING MEDIUM

(75) Inventors: Akihiro Yamada, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 297 days.

(21) Appl. No.: 13/036,258

(22) Filed: Feb. 28, 2011

(65) Prior Publication Data

US 2011/0211853 A1 Sep. 1, 2011

(30) Foreign Application Priority Data

Feb. 26, 2010 (JP) ..... 2010-041908

(51) Int. Cl.
*G03G 15/00* (2006.01)

(52) U.S. Cl.
USPC ..... 399/49

(58) Field of Classification Search
USPC ..... 399/49, 44, 301
See application file for complete search history.

(56) References Cited

U.S. PATENT DOCUMENTS

| | | | | |
|---|---|---|---|---|
| 7,657,214 | B2 * | 2/2010 | Inui et al. | 399/299 |
| 2006/0120772 | A1 | 6/2006 | Kitazawa et al. | |
| 2007/0201889 | A1 * | 8/2007 | Ishizuka et al. | 399/44 |
| 2008/0292338 | A1 * | 11/2008 | Fujiwara | 399/44 |

FOREIGN PATENT DOCUMENTS

| | | | |
|---|---|---|---|
| JP | H05-188831 | A | 7/1993 |
| JP | H07-306553 | A | 11/1995 |
| JP | 2003-131443 | A | 5/2003 |
| JP | 2004-109270 | A | 4/2004 |
| JP | 2006-162652 | A | 6/2006 |
| JP | 2006-208639 | A | 8/2006 |
| JP | 2008-026639 | A | 2/2008 |

OTHER PUBLICATIONS

Japan Patent Office, Notification of Reasons for Refusal for Japanese Patent Application No. 2010-041908, dispatched Jan. 19, 2012.

* cited by examiner

*Primary Examiner* — Walter L Lindsay, Jr.
*Assistant Examiner* — Rodney Bonnette
(74) *Attorney, Agent, or Firm* — Baker Botts L.L.P.

(57) ABSTRACT

An image forming apparatus is provided. The image forming apparatus includes: a forming unit configured to form an image on a relatively moving object, the image including a mark; a first detection unit configured to detect the mark formed by the forming unit so as to obtain a first detection result; a correction unit configured to execute a correction process in which an image forming condition of the image forming unit is changed based on the first detection result; a setting unit configured to set the correction process not to be executed when a value related to a correction accuracy of the correction unit is lower than a reference value; and a control unit configured to control the correction process based on the setting by the setting unit.

14 Claims, 14 Drawing Sheets

FIG. 9

| REFERENCE INTENSITY Z | BELT DETERIORATION LEVEL K |
|---|---|
| $Z3 \leqq Z$ | 3 |
| $Z2 \leqq Z < Z3$ | 2 |
| $Z1 \leqq Z < Z2$ | 1 |
| $Z < Z1$ | 0 |

$(Z3 > Z2 > Z1)$

FIG. 10

| BELT DETERIORATION LEVEL K | CORRECTION INTERVAL H1 | CORRECTION INTERVAL H2 |
|---|---|---|
| 3 | 150 PAGES | 30 MIN |
| 2 | 300 PAGES | 60 MIN |
| 1 | 500 PAGES | 90 MIN |
| 0 | 1000 PAGES (H10) | 120 MIN(H20) |

| |
|---|
| FIG. 14A |
| FIG. 14B |

FIG. 15A

| REFERENCE RANGE X | CORRECTION HISTORY R |
|---|---|
| X1 | × |
| X2 | ○ |
| X3 | ○ |
| X4 | ○ |
| X5 | ○ |
| ... | ... |
| Xn−1 | ○ |
| Xn | × |

FIG. 15B

| REFERENCE RANGE X | CORRECTION HISTORY R |
|---|---|
| X1 | × |
| X2 | × |
| X3 | ○ |
| X4 | ○ |
| X5 | ○ |
| ... | ... |
| Xn−1 | ○ |
| Xn | × |

IMAGE FORMING APPARATUS AND STORING MEDIUM

CROSS-REFERENCE TO RELATED APPLICATIONS

This application claims priority from Japanese Patent Application No. 2010-041908 filed on Feb. 26, 2010, the entire contents of which are incorporated herein by reference.

TECHNICAL FIELD

Aspects of the present invention relate to an image forming apparatus and a storing medium.

BACKGROUND

Traditionally, an image forming apparatus has been used. The image forming apparatus includes a forming unit, which forms an image on an object by transferring the image to a relatively moving object. In the image forming apparatus, if a position of the image formed on the object by the forming unit is not in conformity with a planned image position, a so-called position deviation occurs. Further, if an area of the image that is formed on the object by the forming unit is not in conformity with a planned image area, a so-called color deviation occurs. Related art discloses a correction process that prevents deterioration of image quality due to the position deviation and the color deviation. In the correction process, the position deviation and the color deviation are prevented by detecting a surface condition of the object, determining a position of the image formed on the object based on the detected result, and then executing the correction process.

SUMMARY

In an image forming apparatus, when the surface conditions of the object deteriorates, or when an inside of the apparatus is hot or humid, probability of a success of a correction process becomes low. In related-art, the correction process was executed at a normal frequency under such conditions by selecting a portion having a relatively good surface condition as a detection area. However, if the correction process is executed at a normal frequency under such conditions, a number of failures of the correction process increase. Thus, detection values that can be used in the correction process are reduced, and an accuracy of the correction process decreases.

Accordingly, it is an aspect of the present invention to provide an image forming apparatus capable of preventing the correction process to be executed at low accuracy.

According to an aspect of the present invention, there is provided an image forming apparatus comprising: a forming unit configured to form an image on a relatively moving object, the image including a mark; a first detection unit configured to detect the mark formed by the forming unit so as to obtain a first detection result; a correction unit configured to execute a correction process in which an image forming condition of the image forming unit is changed based on the first detection result; a setting unit configured to set the correction process not to be executed when a value related to a correction accuracy of the correction unit is lower than a reference value; and a control unit configured to control the correction process based on the setting by the setting unit.

According to another aspect of the present invention, there is provided a computer readable storing medium storing a computer program for causing an image forming apparatus, which includes an image forming unit, to perform a method of: forming an image on a relatively moving object, the image including a mark; detecting the mark so as to obtain a first detection result; executing a correction process in which an image forming condition of the image forming unit is changed based on the first detection result; setting the correction process not to be executed when a value related to a correction accuracy of the correction process is lower than a reference value; and controlling the correction process based on the setting.

BRIEF DESCRIPTION OF DRAWINGS

FIG. 9 is a table showing a relationship of a reference intensity Z and a belt deterioration level K;

FIG. 10 is a table showing a relationship of the belt deterioration level K and the correction interval H;

FIG. 15A is a table showing a relationship of a reference range X and a correction history R; and FIG. 15B is a table showing the relationship of the reference range X and the correction history R.

DETAILED DESCRIPTION

First Exemplary Embodiment

The first exemplary embodiment of the invention will be described with reference to FIGS. 1 to 11.

1. Overall Configuration of a Printer

Figure 1:
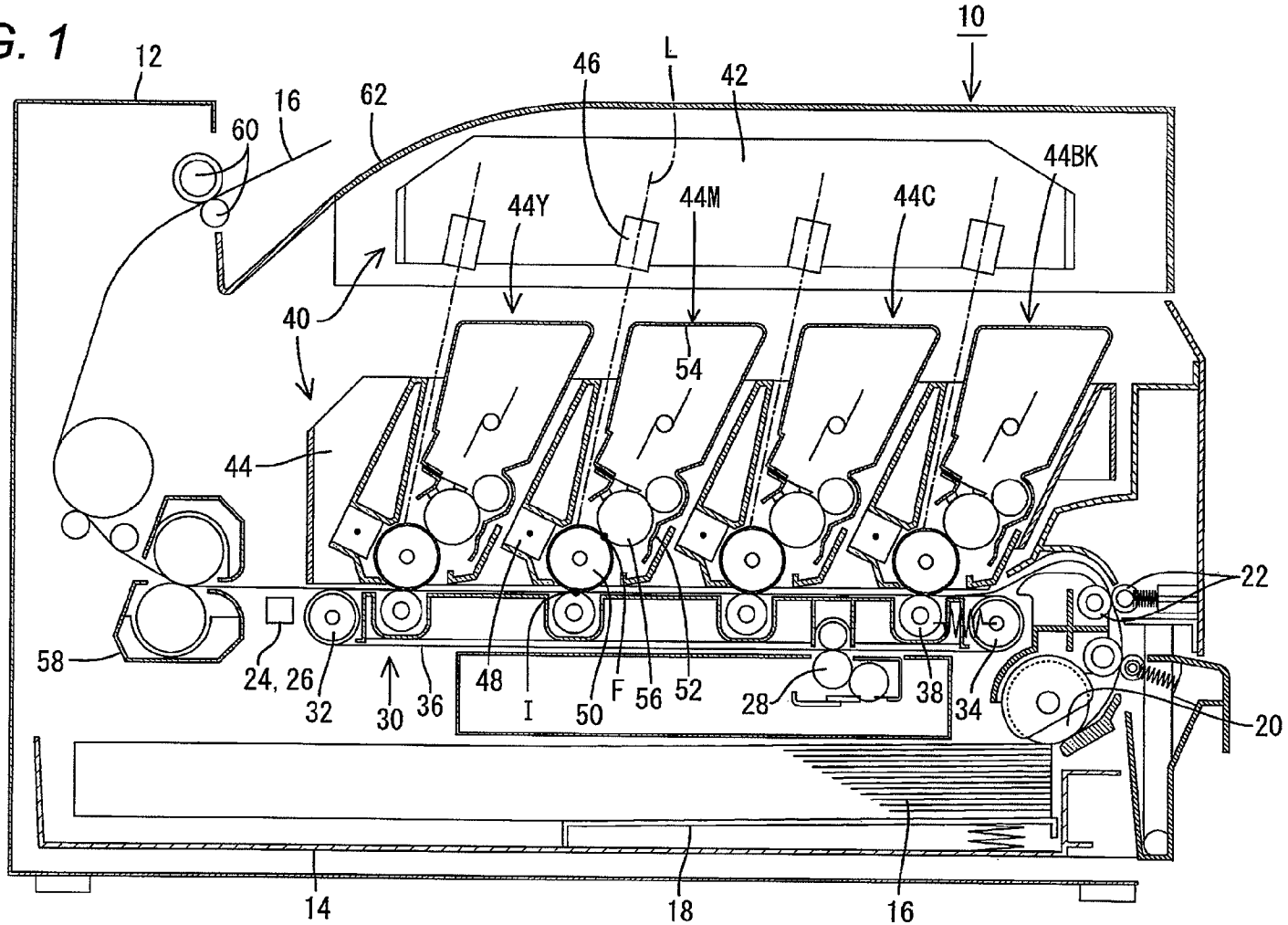
FIG. 1 is a sectional side view of a printer 10.

FIG. 1 is a sectional side view showing schematic configuration of a printer 10 of the first exemplary embodiment. As shown in FIG. 1, the printer 10 is a color laser printer that uses toner of four colors (yellow, magenta, cyan and black) and forms a color image by using a direct transfer tandem method. The printer 10 is formed in a casing 12. A feeding tray 14 is provided at a bottom inside of the casing 12. A sheet material 16 such as a sheet is stacked on the feeding tray 14.

The sheet material 16 is supplied to the feeding tray 14 by a user, and after the sheet material 16 is stored in the casing 12, the sheet material 16 is lifted up by a pressing plate 18, and then the sheet materials 16 is pressed to a pickup roller 20. The sheet material 16 is transferred to a registration roller 22 by rotating the pickup roller 20. After an inclination correction of the sheet material 16 is made by the registration roller 22, the sheet material 16 is sent to a belt unit 30.

The belt unit 30 includes a pair of support rollers 32 and 34, a belt 36 and multiple transfer rollers 38. The belt 36 is constructed between the support rollers 32 and 34. Ends of the belt 36 are connected to form a ring. The transfer rollers 38 are provided inside the ring-shaped belt 36 at equal intervals. The support rollers 32 and 34 are rotated counterclockwise by a motor that is not shown in the figure, and the belt 36 moves accordingly. The sheet material 16 that has been sent to the belt unit 30 moves together with the belt according to the rotation of the belt 36.

An image forming unit 40 is provided upper to the belt unit 30. The image forming unit 40 includes a scanner unit 42 and a process unit 44. The scanner unit 42 (process unit 44) contains four scanner units 42 (process units 44) corresponding to the toner of four colors. When specifying each of the scanner units 42 (process unit 44), one or two alphabets (yellow: Y, magenta: M, cyan: C and black: BK) identifying each color are provided after reference numbers. Each process unit 44 is arranged at equal intervals at a position that corresponds to each transfer roller 38 of the belt unit 30. Each scanner unit 42 is arranged above each of the corresponding process units 44.

The scanner units 42 control each laser emitting units 46 based on each image data sent from a computer 70 (FIG. 2), to irradiate laser light L to surfaces of each photosensitive drums 50 provided on the corresponding process unit 44.

Each process unit 44 includes a charger 48, a photosensitive drum 50 and a developing cartridge 52. The charger 48 charges the surface of the photosensitive drum 50 to be uniformly positive. A toner storage chamber 54 and a developing roller 56 are provided in the developing cartridge 52. The toner storage chamber 54 of the developing cartridge 52 is filled with toner, and the toner in the toner storage chamber 54 is supplied to the developing roller 56.

In the image forming unit 40, when an image is formed on the sheet material 16 or the belt 36, the charger 48 charges the surface of the photosensitive drum 50 to be positive. Next, the laser light L from the laser emitting unit 46 of the scanner 42 is irradiated to the photosensitive drum 50. Thus, an electrostatic latent image corresponding to the image to be formed is formed on the surface of the photosensitive drum 50.

When the photosensitive drum 50 on which the electrostatic latent image was formed passes through a toner supply position F between the photosensitive drum 50 and the developing roller 56, the toner carried on the developing roller 56 is supplied to the surface of the photosensitive drum 50 on which the electrostatic latent image was formed. The toner images of each color are formed on the corresponding photosensitive drum 50 thereby.

When the photosensitive drum 50 on which the toner image was formed passes through a transfer position I between the photosensitive drum 50 and the transfer roller 38, the toner image of the photosensitive drum 50 is transferred to the sheet material 16 (belt 36) that passes the transfer position I, by applying negative transfer bias to the transfer roller 38. As a result, an image is formed on the sheet material 16. In addition, batches 92 and 94 (see FIG. 8) are formed on the belt 36. Each color image is successively formed on the sheet material 16 (belt 36) with the movement of the belt 36. The image formed on the sheet material 16 is sent to a fixing unit 58 and fixed, and is discharged to a discharging tray 62 formed outside the casing 12 by a discharging roller 60.

Figure 8:
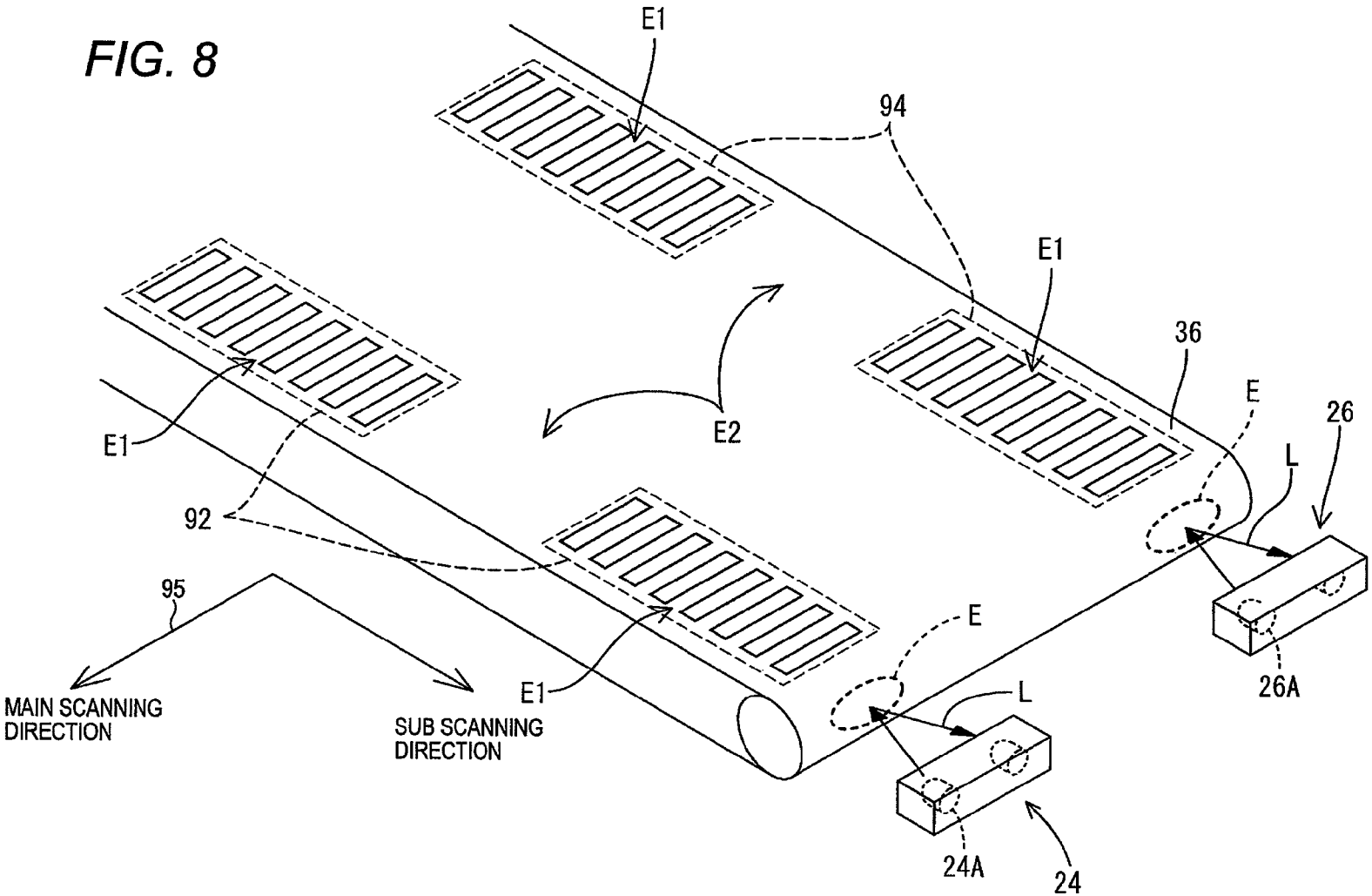
FIG. 8 is a perspective view of optical sensors 24, 26 and a belt 36.

Optical sensors 24 and 26 (e.g., first detection units, second detection units, particular detection units) and a clearing roller 28 are provided lower to the belt unit 30. The optical sensors 24 and 26 can detect the batches 92 and 94 formed on the belt 36. As shown in FIG. 8, the optical sensors 24 and 26 are reflective optical sensors which are arranged side by side in a direction orthogonal to the movement direction of the belt 36, shown by an arrow 95.

The cleaning roller 28 removes toner and paper dust attached to the belt 36. Here, the "the attached toner" includes the batches 92 and 94 intentionally formed on the belt 36 as well as the toner unintentionally attached to the belt.

2. Electrical Configuration of the Printer

Figure 2:
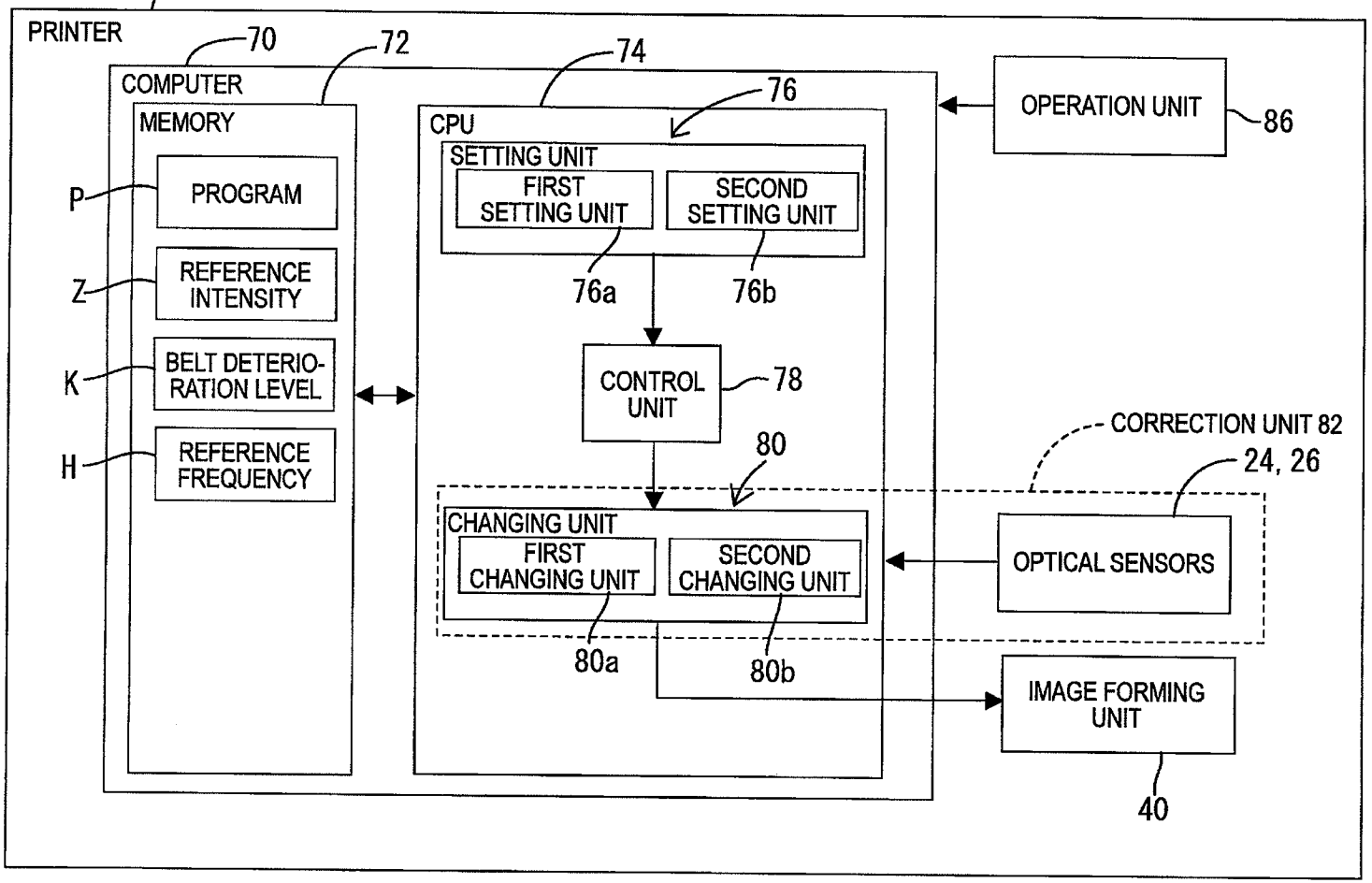
FIG. 2 is a block diagram showing a control system of the printer 10.

FIG. 2 schematically shows a control system of the printer 10. The printer 10 further includes an operation unit 86 and a computer 70. The printer 10 is controlled by the computer 70. The operation unit 86 includes multiple buttons, through which operations such as power ON/OFF and printing start instruction, and correction setting can be input by a user. The computer 70 includes a memory 72 and a Central Processing Unit (CPU) 74. Various programs P are stored in the memory 72 to control operations of the printer 10. The CPU 74 executes various functions of the printer 10 according to the program P which is read from the memory 72.

In the printer 10, four scanner units 42 (process units 44), corresponding to the toner of four colors, are provided to the image forming unit 40. When image forming conditions, such as density and position of an image formed on the sheet material 16 by each scanner unit 42 (process unit 44), are not adjusted, image quality of the images formed on the sheet material 16 deteriorates. Therefore, the program P is stored in the memory 72 of the computer 70 to correct the image forming condition of each scanner unit 42 (process unit 44), and the program P is executed under certain conditions. At this time, as shown in FIG. 2, the CPU 74 functions as a setting unit 76 and a control unit 78. In addition, the CPU 74 functions as a changing unit 80. The CPU 74 that functions as the changing unit 80 functions as a correction unit 82 by operating together with the optical sensors 24 and 26. The correction unit 82 corrects the image forming condition of each scanner unit 42 (process unit 44) by controlling the image forming unit 40 and using a reference intensity Z (an example of reference conditions), a belt deterioration level K (an example of reference value) and a correction interval H (an example of reference frequency) stored in the memory 72.

3. Correction Process of the Formed Image

Figure 3:
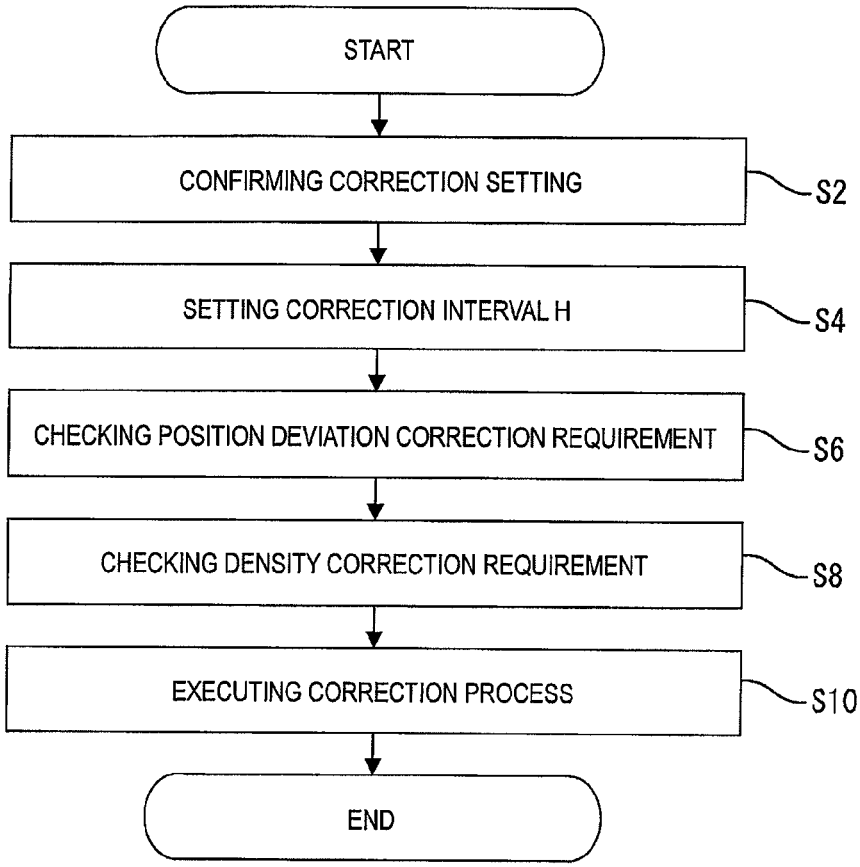
FIG. 3 is a flowchart showing a controlling process of the printer 10.

With reference to FIG. 3, the correction process to the image forming condition of the printer 10 will be described. The correction process is repeatedly executed after the power is supplied to the printer 10.

When the correction process starts, the CPU 74 confirms the correction setting input by a user (S2). Next, the CPU 74 sets the correction interval H of the correction unit 82 (S4).

Figure 4:
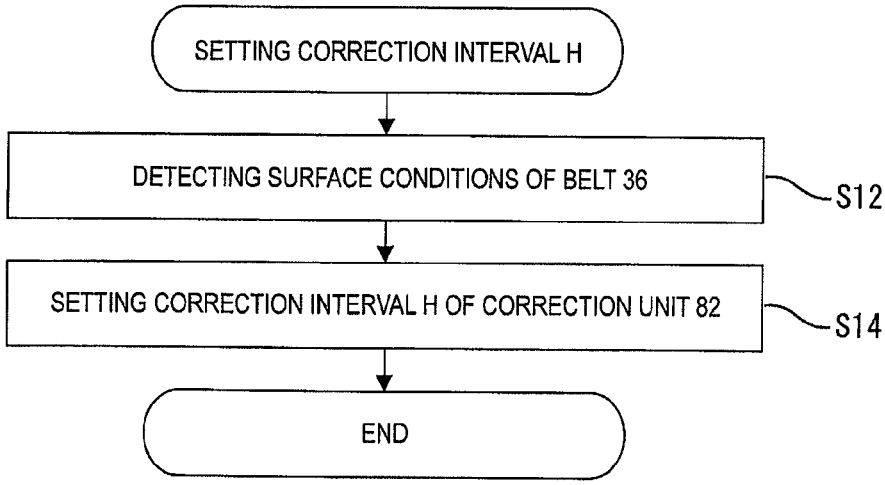
FIG. 4 is a flowchart showing setting of a correction interval H.
Figure 5:
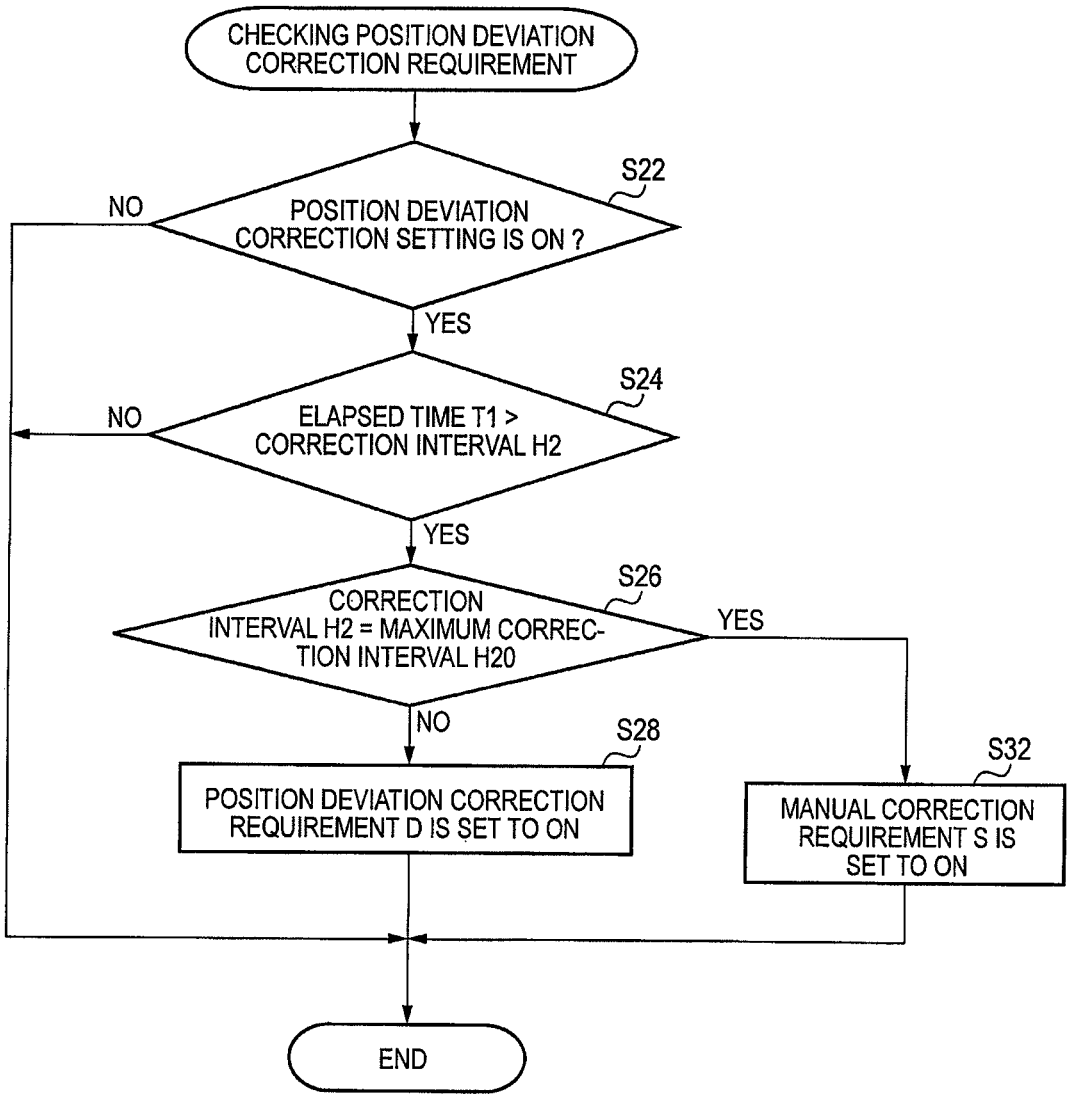
FIG. 5 is a flowchart showing checking of a position deviation correction requirement.
Figure 6:
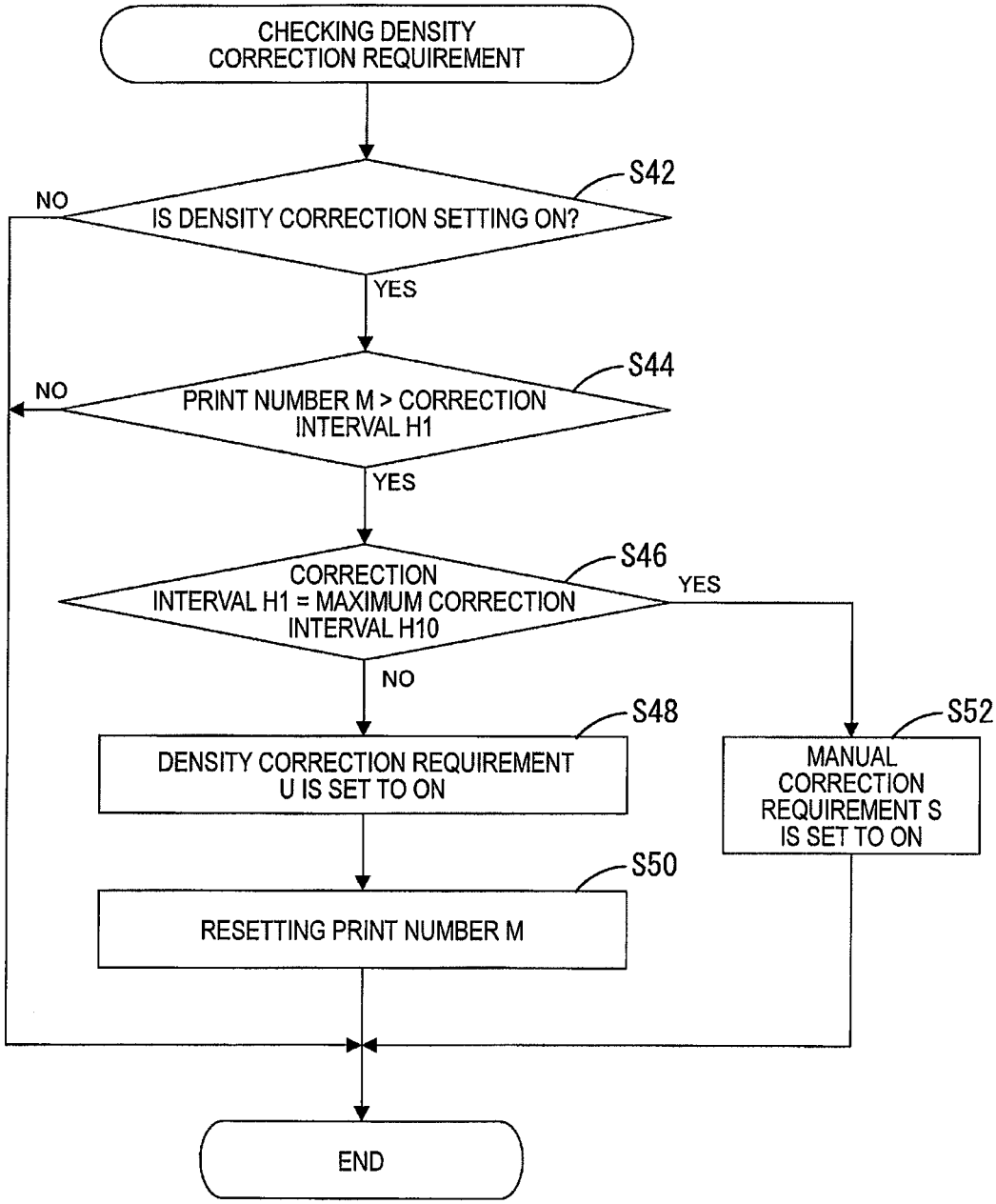
FIG. 6 is a flowchart showing checking of a density correction requirement.
Figure 7:
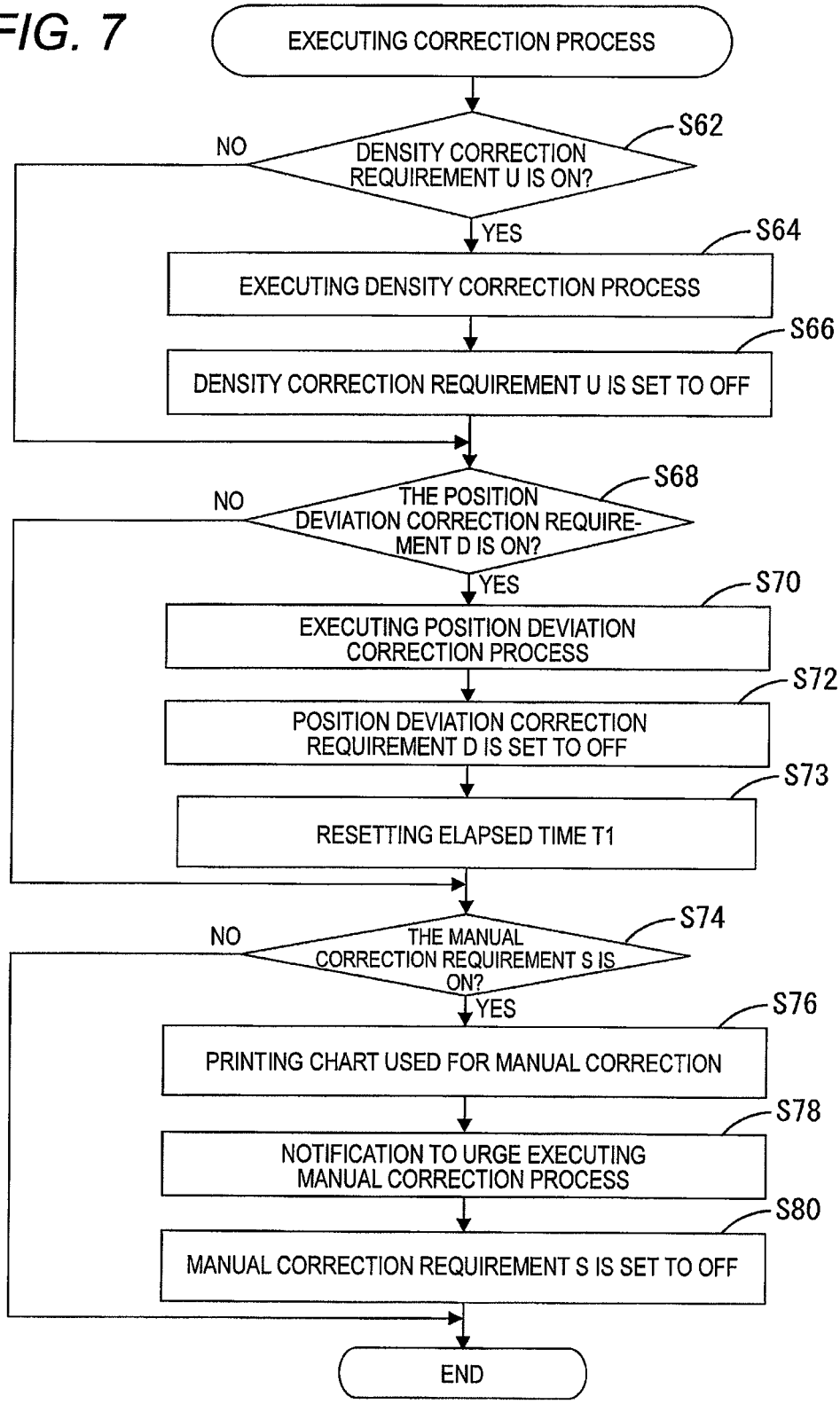
FIG. 7 is a flowchart showing a correction process.

In S4, the CPU 74 functions as the setting unit 76, and executes the following processes shown in FIG. 4.

The CPU 74 controls the optical sensors 24 and 26, and detects the surface condition of the belt 36 (S12). In particular, the surface condition of the belt 36 is detected by the optical sensors 24 and 26 with the movement of the belt 36. As shown in FIG. 8, the optical sensors 24 and 26 irradiates the light from light sources 24*a* and 26*a* inside the optical sensors 24 and 26 to the detected area E on the surface of the belt 36, and measures an intensity of light L reflected from the belt 36, and the measurement result (an example of a second detection result) is transmitted to the CPU 74.

Next, the CPU 74 selects the belt deterioration level K based on the measurement result (S14). In this case, the belt deterioration level K may be selected by using an average value of the measurement result for one circuit of the belt, which has been calculated, or by using a lowest intensity among the measurement result of one circuit of the belt. The CPU 74 compares the measurement result transmitted from the optical sensors 24 and 26 with the reference intensity Z stored in the memory 72. As shown in FIG. 9, the reference intensity Z is stored in the memory 72 in correspondence with the belt deterioration level K. The belt deterioration level K set in the memory 72 decreases as the reference intensity Z decreases. When the belt 36 deteriorates, and the measurement result measured by the optical sensors 24 and 26 is low, the belt deterioration level K is lower than the original state (belt deterioration level K is 3). The CPU 74 determines the reference intensity Z based on the measurement result, and selects the belt deterioration level K corresponding to the reference intensity Z.

Next, the CPU 76 determines the correction interval H based on the selected belt deterioration level K, and sets the correction interval H of the correction unit 82 (S14). As shown in FIG. 10, the correction interval H corresponding to the belt deterioration level K is set in the memory 72. In the memory 72, the correction interval H is set so as to increase as the belt deterioration level K decreases, so that the correction frequency decreases. In other words, the correction process is set so as not to be executed as the belt deterioration level K decreases. The CPU 74 determines the correction interval H corresponding to the selected belt deterioration level K, and sets it as the correction interval H of the correction unit 82.

In the first exemplary embodiment, the correction interval H1 of the density deviation correction by the first correction unit (that is, the first changing unit 80*a* and the optical sensors 24 and 26), which is set by the first setting unit 76*a*, is set by using the print number of the sheet material 16 since the previous correction process was executed. In addition, the correction interval H2 of the position deviation correction by the second correction unit (that is, the second changing unit 80*b* and the optical sensors 24 and 26), which is set by the second setting unit 76*b*, is set by using the elapsed time since the previous position deviation correction was executed. In the first exemplary embodiment, in order to execute the correction process according to each image forming condition, the correction interval H is set under separate conditions by the first correction unit and the second correction unit. When the belt 36 deteriorates and the measurement result measured by the optical sensors 24 and 26 decreases, the correction interval H1 is set larger than that of the original state (correction interval H1: 30 min, correction interval H2: 150 pages). That is, the correction interval H1 is set so that the correction frequency decreases.

Next, the CPU 74 executes a checking process of the position deviation correction requirement (S6). The CPU 74 functions as the control unit 78 in S6, and executes the following processes shown in FIG. 5.

The CPU 74 confirms the position correction setting confirmed in S2 (S22). An elapsed time T1, which is a time elapsed since the previous position deviation correction was executed, has been measured by the CPU 74, and when the position deviation correction setting is ON (S22 is YES), the CPU 74 compares the elapsed time T1 and the correction interval H2 (S24). When the elapsed time T1 is smaller than the correction interval H2 (S24 is NO), the CPU 74 terminates the checking process of the position deviation correction requirement. When the elapsed time T1 exceeds the correction interval H2 (S24 is YES), the CPU 74 determines whether the correction interval H2 is equal to the maximum correction interval H20 (120 minutes) (S26). When the correction interval H2 is equal to the maximum correction interval H20 (S26 is YES), the CPU 74 sets the manual correction requirement S to ON (S32). When the correction interval H2 is smaller than the maximum correction interval H20 (S26 is NO), the CPU 74 sets the position deviation correction requirement D to ON, and terminates the checking process of the position deviation correction requirement (S28). Meanwhile, when the position deviation correction setting is OFF (S22 is NO), the CPU 74 terminates the checking process of the position deviation correction requirement.

Next, the CPU 74 executes a checking process of the density correction requirement (S8). The CPU 74 functions as the control unit 78 in S8, and executes the following processes shown in FIG. 6.

The CPU 74 confirms the density correction setting confirmed in S2 (S42). A print number M of the printer 10, which is a number of printing since a previous density correction was executed, has been measured by the CPU 74, and when the density correction setting is ON (S42 is YES), the CPU 74 compares the print number M and the correction interval H1 (S44). When the print number M is smaller than the correction interval H1 (S44 is NO), the CPU 74 terminates the checking process of the density correction requirement. When the print number M exceeds the correction interval H1 (S44 is YES), the CPU 74 determines whether the correction interval H1 is equal to the maximum correction interval H10 (300 pages) (S46). When the correction interval H1 is equal to the maximum correction interval H10 (S46 is YES), and the manual correction requirement S is not set to ON in the checking process of the position deviation correction requirement, the CPU 74 sets the manual correction requirement S to ON (S52). When the correction interval H1 is smaller than the maximum correction interval H10 (S46 is NO), the CPU 74 sets the density correction requirement to ON, and resets the print number M (S50), and terminates the checking process of the density correction requirement. Meanwhile, when the position deviation correction setting is OFF (S42 is NO), the CPU 74 terminates the checking process of the position deviation correction requirement.

When the correction interval H1 is equal to the maximum correction interval H10, or the correction interval H2 is equal to the maximum correction interval H20, the CPU 74 sets the manual correction requirement S to ON (S32). As shown in FIG. 10, when the correction interval H1 is equal to the maximum correction interval H10 (or the correction interval H2 is equal to the maximum correction interval H20), the belt deterioration level K is small, and the probability that the belt is deteriorated is high. In the first exemplary embodiment, in this kind of case, by requiring that the correction process be executed manually by a user and preventing the correction process by the correction unit 82, the execution of the correction process at low accuracy can be prevented.

Next, the CPU 74 executes the correction process (S10). The CPU 74 functions as the changing unit 80 (correction unit 82) in S10, and executes the following processes shown in FIG. 7.

The CPU 74 executes the density correction process prior to the position deviation correction process. In the position deviation correction process, in order to exactly detect the positions of the batches 92 and 94 formed on the belt 36 by using the optical sensors 24 and 26, it is necessary to previously form the batches 92 and 94 in density which is higher than a predetermined density. The execution of the position deviation correction process in low accuracy can be prevented by executing the density correction process prior to the position deviation correction process.

When the CPU 74 executes the density correction process, the density correction requirement U is confirmed first (S62). When the density correction requirement U is ON (S62 is YES), the CPU 74 executes the density correction process (S64). In the density correction process, as shown in FIG. 8, the CPU 74 controls the image forming unit 40 so as to form the batches 92 and 94 to be used for density correction on the surface of the belt 36. The CPU 74 controls the optical sensors 24 and 26 to detect the reflected light intensity of the belt 36 of an area E1 in which the batches 92 and 94 are formed. The CPU 74 changes the image forming conditions of the image forming unit 40 so that an amplitude of an area that the detected reflected light intensity (an example of the first detection result) exceeds a predetermined threshold value matches a reference amplitude. After the density correction process is executed, the density correction requirement U is turned OFF (S66). Meanwhile, when the density correction requirement U is OFF (S 62 is NO), the density correction process is not executed.

Next, the CPU 74 executes a position deviation correction process. When the CPU 74 executes the position deviation correction process, the position deviation correction requirement D is confirmed (S68). When the position deviation correction requirement D is ON (S68 is YES), the CPU 74 executes the position deviation correction process (S70). Similar to the density correction process, the CPU 74 detects the reflected light intensity of the belt 36 of the area E1 in which the batches 92 and 94 are formed. The CPU 74 changes the image forming conditions of the image forming unit 40 so that a position of an area that the detected reflected light intensity exceeds a predetermined threshold value matches a reference position in the moving direction of the belt 36. After the position deviation correction process is executed, the position deviation correction requirement D is turned OFF (S72). After that, the elapsed time T1 is reset, and then, the elapsed time T1 starts to be counted again (S73). Meanwhile, when the position deviation correction requirement D is OFF (S68 is NO), the position deviation correction process is not executed.

Figure 11:
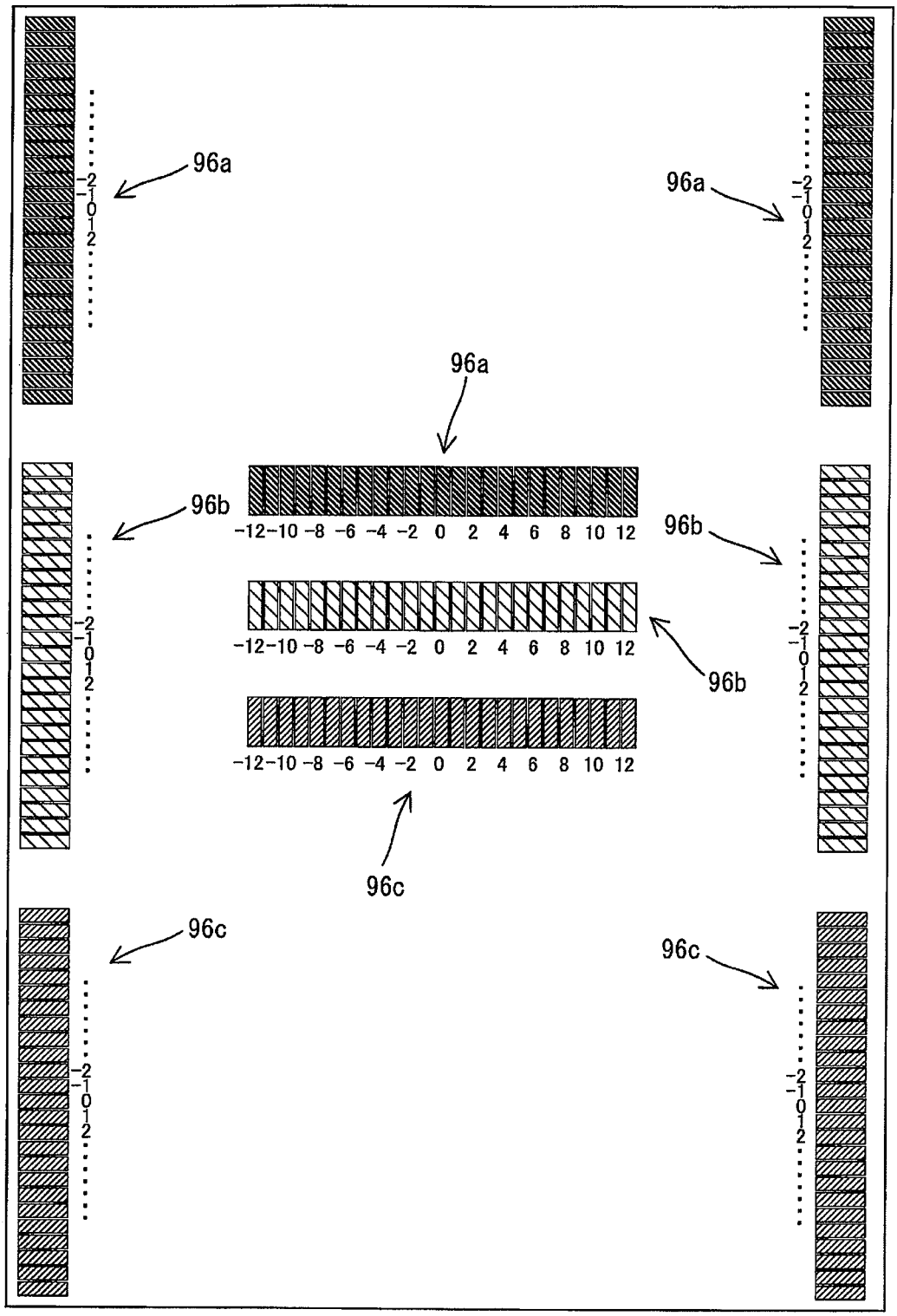
FIG. 11 is a chart used for manual correction.

Next, the CPU 74 executes a manual correction process. When the CPU 74 executes the manual correction process, the manual correction requirement S is confirmed (S74). When the manual correction requirement S is ON (S 74 is YES), the CPU 74 controls the image forming unit 40 and prints a chart used for manual correction shown in FIG. 11 on the sheet material 16 (S76). FIG. 11 is a chart used for manual correction of color deviation correction.

As shown in FIG. 11, multiple identification marks 96 are described in the chart used for manual correction to correct manually the image forming conditions (density, position deviation) of the image forming unit 40. A first identification mark 96*a* adjusting the image forming condition between black and magenta, a second identification mark 96*b* adjusting the image forming condition between black and cyan, and a third identification mark 96*c* adjusting the image forming condition between black and yellow are formed in each identification mark 96. Each identification mark 96*a*, 96*b* and 96*c* are arranged on left and right sides of a short edge of the sheet material 16 (corresponding to a sub-scanning direction of the belt 36) and in the center of the sheet material 16.

Next, the CPU 74 urges the user to execute the manual correction process according to a notification by a notification unit provided to the operation unit 86 (S78). Even when the correction accuracy of the correction process executed by the correction unit 82 is evaluated to be low, a certain degree of correction accuracy can be ensured by manually executing the correction process by a user. A user that notices the printing of the chart used for the manual correction and the notification by the notification unit inputs values that are related to the position deviation corresponding to each identification mark 96*a*, 96*b* and 96*c*. According to the value input based on the identification marks 96*a*, 96*b* and 96*c* that are arranged on the left and right sides, the CPU 74 corrects the image forming conditions of the image forming unit 40 in the main scanning direction of the belt 36. In addition, according to the value input based on each identification mark 96*a*, 96*b* and 96*c* that are arranged in the center, the CPU 74 corrects the image forming conditions of the image forming unit 40 in the sub-scanning direction of the belt 36. After the above processes have been executed, the CPU 47 sets the manual correction requirement S as OFF (S80). Meanwhile, the density correction can be corrected manually by, printing a chart to be used for manual correction of the density correction, which is different from that of FIG. 11, inputting a density deviation value visually determined by the user, and executing the density correction based on the input density deviation value.

In the first exemplary embodiment, when the belt 36 deteriorates, and the measurement result measured by the optical sensors 24 and 26 is low, the correction frequency is set to be low. In other words, the correction process is set not to be executed. According to the first exemplary embodiment, even if the correction accuracy of the correction unit 82 is evaluated to be low, the number of failures of the correction process can be low, and the execution of the correction process in low accuracy can be prevented.

Second Exemplary Embodiment

The second exemplary embodiment of the invention will be described with reference to FIGS. 12 to 15.

Figure 12:
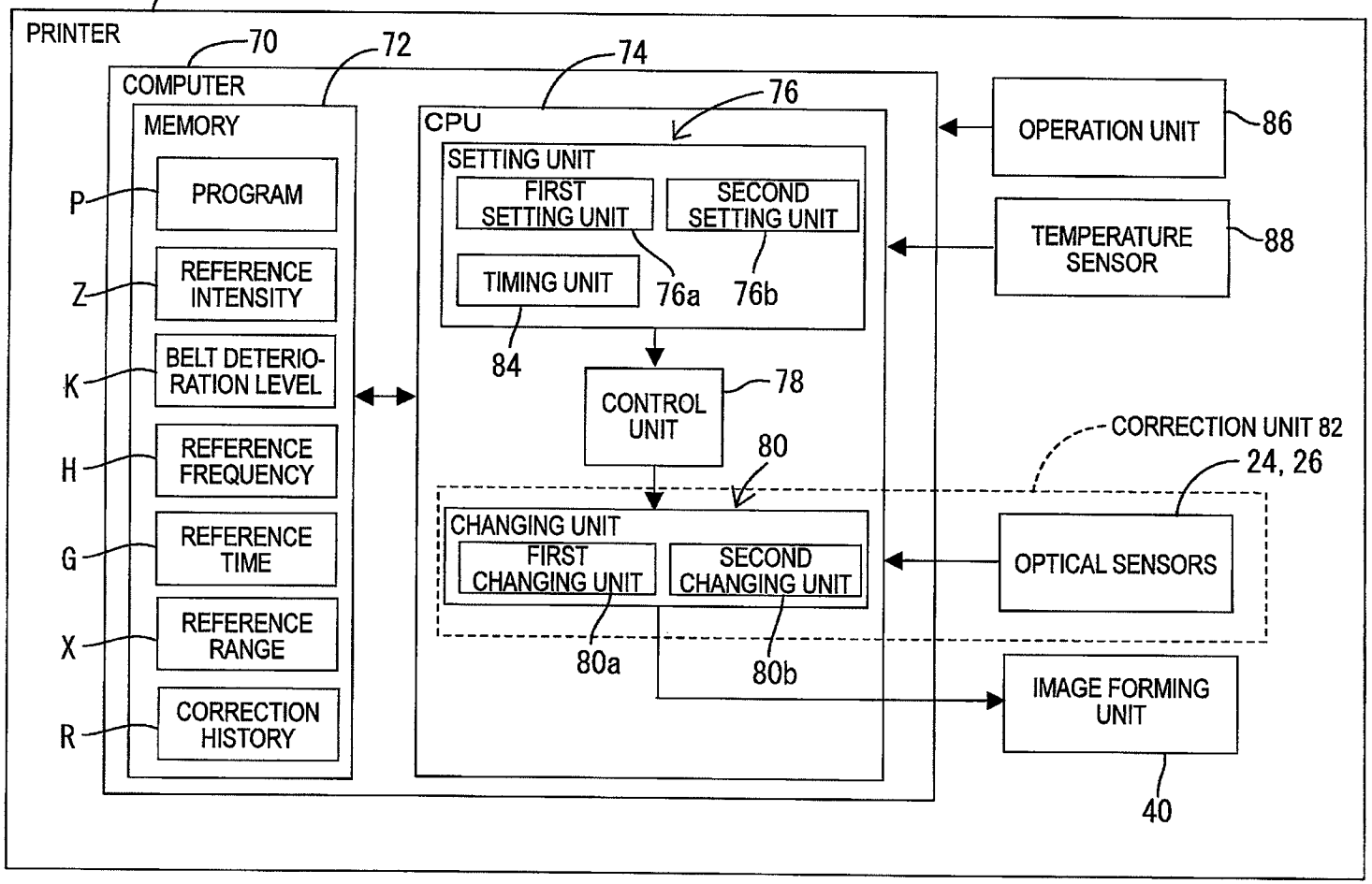
FIG. 12 is a block diagram showing a control system of a printer 110.

FIG. 12 schematically shows a control system of a printer 110 of the second exemplary embodiment. The printer 110 includes a temperature sensor 88 (an example of the third detection unit) that detects a temperature Q (an example of the third detection result) inside the printer 110. The CPU 74 includes a timing unit 84 to measure the time N during which the density correction process is executed. Reference time G, which is a reference of the elapsed time T2 (an example of the measuring time) from the execution time N of the density correction process, is stored in the memory 72. In addition, as shown in FIG. 15*a*, a reference range X, which is a reference of the temperature Q detected by the temperature sensor 88, is stored in the memory 72 in correspondence with a correction history R of the position deviation correction process of the printer 110. The correction history R is a record showing whether the correction process was normally executed in the printer 110. "The correction process was not normally executed" means that, for example, the amount of data that can be used by the correction process among the amount of data detected by using the batches 92 and 94 is not enough, or the correction process was interrupted. For the reference range X and the correction history R that are stored as to correspond to each other, for example, an initial value "O", showing that the correction process can be normally executed, is stored in the correction history R corresponding to all the reference ranges X prepared by printer manufactures. When the correction process is executed, and the correction process is not executed normally, "X" is stored in the correction history corresponding to the temperature when the correction process is executed. As shown in the reference range X2, when the correction process executed for the reference range X2 is normally executed until now, "O" is stored in the correction history R corresponding to the reference range X2. On the other hand, as shown in the reference range X1, when the correction process executed for the reference range X1 is not normally executed until now, "X" is stored in the correction history R corresponding to the reference range X1.

Figure 13:
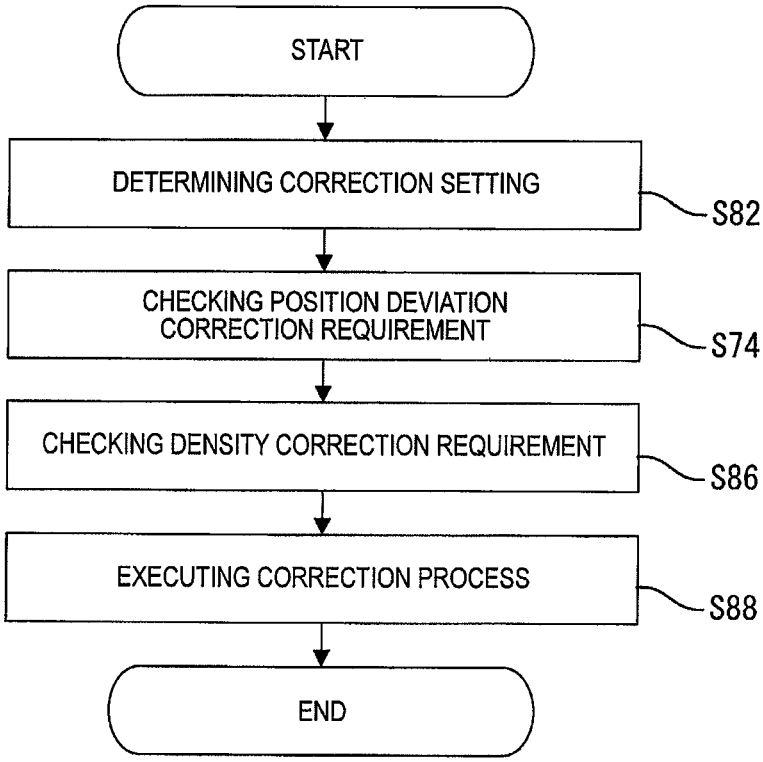
FIG. 13 is a flowchart showing a correction process of the printer 110.
Figures 14, 14A:
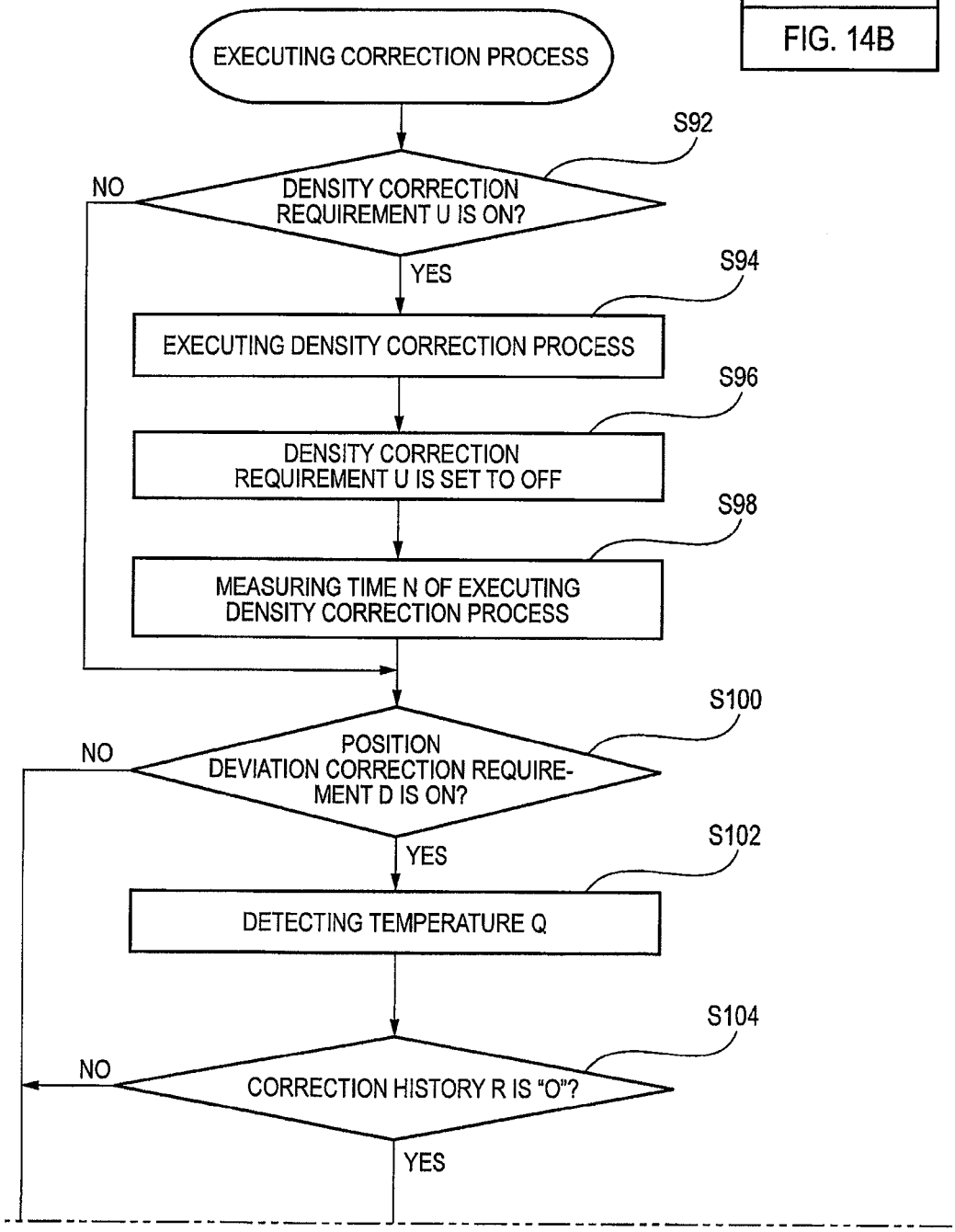
FIG. 14 (14A, 14B) is a flowchart showing a correction process.
Figure 14B:
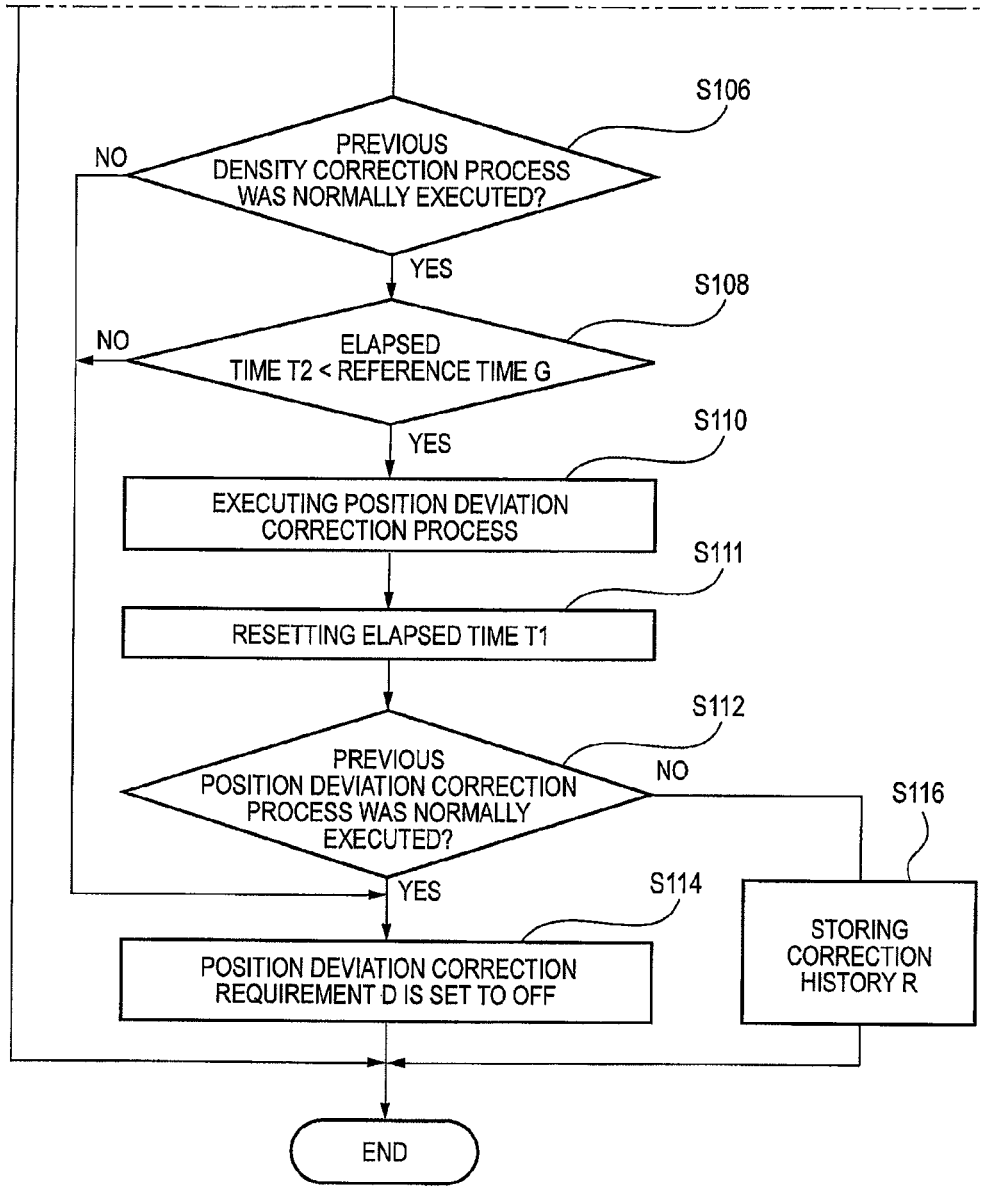

With reference to FIG. 13, a correction process of the image forming condition of the printer 110 will be described.

When the correction process starts, the CPU 74 confirms the correction setting input by a user (S82). Next, the CPU 74 executes the checking process of the position deviation correction requirement (S84) and the checking process of the density correction requirement (S86) without setting the correction interval H of the correction unit 82, which is different from the first exemplary embodiment 1. The processes of S84 and S86 are same as the processes described in the first exemplary embodiment by using the same names, and repeated explanation is omitted.

Next, the CPU 74 executes the correction process (S88). The CPU 74 function as the changing unit 80 (correction unit 82) in S88, and executes the following processes shown in FIG. 14 (14A, 14B).

The CPU 74 first executes the density correction process. When the density correction requirement is ON (S92 is YES), the CPU 74 executes the density correction process (S94).

In the second exemplary embodiment, when the density correction process is executed, the correction interval H of the correction unit 82 is set at the same time. In other words, as shown in FIG. 8, when the CPU 74 detects the reflected light intensity of the belt 36 of the area E1 in which the batches 92 and 94 are formed, the CPU 74 simultaneously detects the reflected light intensity of the belt 36 of an area E2 in which the batches 92 and 94 are not formed. The CPU 74 uses the reflected light intensity of the belt 36 detected from the area E1 in which the batches 92 and 94 are formed to execute the density correction process. In addition, the CPU 74 uses the reflected light intensity of the belt 36 detected from the area E2 in which the batches 92 and 94 are not formed to set the correction interval H (for the first correction interval H1, the correction interval H1 of the density correction process executed subsequently). The detection of the reflected light intensity of the belt 36 which is necessary for the density correction process, and the detection of the reflected light intensity of the belt 36 which is necessary for the setting of the correction interval H can be executed at the same time, so that time necessary for the correction process is reduced. In addition, for the density correction process and the setting process of the correction interval H, the processes are same as the processes described in the first exemplary embodiment by using the same names, and repeated explanation is omitted.

After the density correction process is executed, the CPU 74 sets the density correction requirement U to OFF (S96), and the time N during which the density correction process is executed is measured (S98). Meanwhile, when the density correction requirement U is OFF (S92 is NO), the density correction process is terminated.

Next, the CPU 74 executes the position deviation correction process. The CPU 74 confirms the position deviation correction requirement D (S100). When the position deviation correction requirement D is ON (S100 is YES), the CPU 74 executes the processes described hereinafter. Meanwhile, when the position deviation correction requirement D is OFF (S100 is NO), the CPU 74 terminates the position correction process. When the position deviation correction requirement D is ON (S100 is YES), the CPU 74 controls the temperature sensor 88 to detect the temperature Q inside the printer (S102). The CPU 74 compares the detected temperature Q with the reference range X stored in the memory 72 (S104). When the detected temperature Q is within the reference range X corresponding to the correction history R showing "O" (S104 is YES), the CPU 74 proceeds to the next process (S106).

On the other hand, when the detected temperature Q is within the reference range X corresponding to the correction history R showing "X" (S104 is NO), the CPU 74 terminates the position deviation correction process without setting the position deviation correction requirement D to OFF. In the second exemplary embodiment, when the correction history R is "X", the position deviation correction process is not executed. When the correction history R is "X", the execution of the position deviation correction process in low accuracy can be prevented by not executing the correction process when the correction process may fail. In the second exemplary embodiment, by not setting the position deviation correction requirement D to OFF in the above-described case, the position deviation correction requirement D is maintained as ON, until the detected temperature Q in the subsequent correction process changes to a temperature of the reference range X corresponding to a correction history R showing "O". Thus, when the detected temperature Q changes to a temperature within the reference range X corresponding to the correction history R showing "O", the position deviation correction process is definitely executed.

The CPU 74 stores the result of the previously executed density correction process, and proceeds to execute the next process (S108) when the previously executed density correction process is normally executed (S106 is YES).

Meanwhile, when the previously executed density correction process is not normally executed (S106 is NO), the CPU 74 sets the position deviation correction requirement to OFF (S114), and terminates the position deviation correction process. When the previously executed density correction process executed is not normally executed, the probability that, the position deviation correction process executed by the same procedure will not be normally executed, is high. By not executing the position deviation correction process when the previously executed density correction process is not normally executed, the execution of the position deviation correction process in low accuracy can be prevented.

Next, the CPU 74 calculates the elapsed time T2 since the execution time N of the density correction process, and compares the elapsed time T2 with the reference time G stored in the memory 72 (S108). When the elapsed time T2 is shorter than the reference time G (S108 is YES), after executing the position deviation correction process (S110), the CPU 74 resets the elapsed time T1 and starts counting the elapsed time T1 again (S111). For the position deviation correction process, the processes are same as the processes described in the first exemplary embodiment by using the same names, and repeated explanation is omitted.

Meanwhile, when the elapsed time T2 is longer than the reference time G (S108 is NO), the CPU 74 sets the position deviation correction requirement to OFF (S114), and terminates the position deviation correction process. Generally, it is well known that the shorter the elapsed time since the previously executed correction process, the more likely the next correction process will succeed. In the invention, because the position deviation correction is not executed when the elapsed time T2 since the execution time N of the previously executed density correction process is longer than the reference time G, the execution of the position deviation correction process in low accuracy can be prevented.

The CPU 74 stores the result of the position deviation correction process, and when the previously executed position deviation correction process is normally executed (S112 is YES), sets the density correction requirement U to OFF (S114). Meanwhile, when the previously executed position deviation correction process is not normally executed (S112 is NO), the result is stored in the correction history R. For example, when the temperature Q detected in S102 is within the reference range X2, as shown in FIG. 15B, the correction history R corresponding to the reference range X2 is changed to "X".

When the previously executed position deviation correction process is not normally executed (S112 is NO), the CPU 74 does not set the position deviation correction requirement to OFF. In the second exemplary embodiment, because in the above case the position deviation correction requirement D is not set to OFF, when the temperature Q detected in the next correction process changes to a temperature within the reference range X corresponding to the correction history R showing "O", the position deviation correction process is definitely executed.

The present invention is not limited to the exemplary embodiments described by the above description and the drawings. For example, the following embodiments may also fall in the scope of the invention.

For example, the image forming apparatus is not limited to a color printer. It can be a monochrome printer, or a so called multi-functional device that includes a copy function, and the like.

Further, in the second exemplary embodiment, whether to execute the correction process is determined based on the temperature inside the printer 110, but whether to execute the correction process can also be determined based on the humidity inside the printer 110 and both the temperature and the humidity inside the printer 110. Further, the correction process, which has been determined to be executed or not, is not limited to the position deviation correction process. In the second exemplary embodiment, for the color deviation correction process, whether the correction process is executed is judged based on the temperature (S104), which is also suitable for the density correction.

Each of the technical elements described in this specification or the drawings has technical utility as a sole or various combinations thereof, and are not limited to combinations defined in the claims at the time of the filing of the application. Further, the technology exemplarily described in this specification or the drawings can simultaneously achieve a plurality of objects, and technical utility can be obtained when one of the plurality of objects is achieved.

What is claimed is:

1. An image forming apparatus comprising:

a forming unit configured to form an image on a relatively moving object, the image including a mark;

a first detection unit configured to detect the mark formed by the forming unit so as to obtain a first detection result;

a correction unit configured to execute a correction process in which an image forming condition of the image forming unit is changed based on the first detection result;

a setting unit configured to set the correction process not to be executed when a value related to a correction accuracy of the correction unit is lower than a reference value; and a control unit configured to control the correction process based on the setting by the setting unit, wherein the setting unit is configured to set a reference frequency of a correction frequency of the correction unit to decrease as the reference value decreases.

2. The image forming apparatus according to claim 1, further comprising a memory configured to store a plurality of combinations of the reference value and the reference frequency.

3. The image forming apparatus according to claim 1, wherein when the value related to the correction accuracy of the correction unit is lower than the reference value, the setting unit sets the correction unit to execute the correction process based on a manual instruction.

4. The image forming apparatus according to claim 1, further comprising a second detection unit configured to detect a surface condition of the object so as to obtain a second detection result, wherein when the second detection result shows that the surface condition of the object is more deteriorated than a reference condition, the setting unit evaluates that the value related to the correction accuracy of the correction unit is lower than the reference value.

5. The image forming apparatus according to claim 4, wherein a detection mechanism is configured to serve as both the first detection unit and the second detection unit.

6. The image forming apparatus according to claim 4, wherein a detection mechanism is configured to detect the mark formed on the object and the surface condition of the object in a single operation.

7. The image forming apparatus according to claim 4, further comprising a storage unit configured to store the second detection result obtained by the second detection unit or a third detection result obtained by a third detection unit in correspondence with information related to the first detection result of the correction process executed when the second detection result or the third detection result is obtained, wherein the setting unit evaluates whether the value related to the correction accuracy of the correction unit is lower than the reference value based on the information stored in the storage unit.

8. The image forming apparatus according to claim 1, further comprising a third detection unit configured to detect at least one of temperature and humidity inside the image forming apparatus so as to obtain a third detection result, wherein when the third detection result is outside a reference range, the setting unit evaluates that the value related to the correction accuracy of the correction unit is lower than the reference value.

9. The image forming apparatus according to claim 8, wherein when the third detection result changes from the outside of the reference range to an inside of the reference range, the setting unit sets the correction process to be executed.

10. The image forming apparatus according to claim 1, wherein the correction unit includes:

a first correction unit configured to execute a first correction process that corrects a first image forming condition of the forming unit; and a second correction unit configured to execute a second correction process that corrects a second image forming condition of the forming unit, and the setting unit includes:

a first setting unit configured to set the first correction process not to be executed by the first correction unit under a first condition; and a second setting unit configured to set the second correction process not to be executed by the second correction unit under a second condition that is different from the first condition.

11. The image forming apparatus according to claim 10, wherein the correction unit is configured to execute the second correction process after the first correction process, wherein the setting unit includes a timing unit configured to measure a time period from the execution of the first correction process to the execution of the second correction process, and wherein, when the time period measured by the timing unit is longer than a reference time period, the second setting unit is configured to evaluate that a value related to a correction accuracy of the second correction unit is lower than the reference value.

12. The image forming apparatus according to claim 10, wherein the first correction unit is configured to execute a density correction process as the first correction process, wherein the second correction unit is configured to execute a position deviation correction process as the second correction process, wherein the correction unit is configured to execute the second correction process after the first correction process has been executed, and wherein the second setting unit is configured to evaluate whether a value related to a correction accuracy of the second correction unit is lower than the reference value based on information related to a result of the first correction process.

13. A non-transitory computer readable storing medium storing a computer program for causing an image forming apparatus, which includes an image forming unit, to perform a method of:

forming an image on a relatively moving object, the image including a mark;

detecting the mark so as to obtain a first detection result;

executing a correction process in which an image forming condition of the image forming unit is changed based on the first detection result;

setting the correction process not to be executed when a value related to a correction accuracy of the correction process is lower than a reference value; and controlling the correction process based on the setting, wherein the setting comprises setting a reference frequency of a correction frequency of executing the correction process to decrease as the reference value decreases.

14. An image forming apparatus comprising:

a forming unit configured to form an image on a relatively moving object, the image including a mark;

a particular detection unit configured to detect the mark formed by the forming unit so as to obtain a particular detection result;

a correction unit configured to execute a correction process in which an image forming condition of the image forming unit is changed based on the particular detection result;

a setting unit configured to set the correction process not to be executed when a value related to a correction accuracy of the correction unit is lower than a reference value;

a control unit configured to control the correction process based on the setting by the setting unit; and a further detection unit configured to detect at least one of temperature and humidity inside the image forming apparatus so as to obtain a further detection result, wherein when the further detection result is outside a reference range, the setting unit evaluates that the value related to the correction accuracy of the correction unit is lower than the reference value.

* * * * *